United States Patent [19]

Ragettli

[11] Patent Number: 4,909,056

[45] Date of Patent: Mar. 20, 1990

[54] METHOD AND AN APPARATUS FOR COLD-ROLL FORMING OF ANNULAR WORKPIECES

[75] Inventor: Christian Ragettli, Zurich, Switzerland

[73] Assignee: Christian Ragettli AG, Zurich, Switzerland

[21] Appl. No.: 171,758

[22] Filed: Mar. 22, 1988

[30] Foreign Application Priority Data

Apr. 7, 1987 [CH] Switzerland ..... 01326/87
Apr. 30, 1987 [CH] Switzerland ..... 01655/87

[51] Int. Cl.[4] ..... B21H 1/10
[52] U.S. Cl. ..... 72/91
[58] Field of Search ..... 72/91, 93, 105, 108, 72/109, 111; 29/159.1

[56] References Cited

U.S. PATENT DOCUMENTS 3,855,833 12/1974 Connell ..... 72/105
4,241,596 12/1980 Nagatsuma et al. ..... 72/91
4,316,374 2/1982 Nagatsuma ..... 72/91

FOREIGN PATENT DOCUMENTS 2002204 7/1971 Fed. Rep. of Germany ..... 72/91
194046 3/1967 U.S.S.R. ..... 72/91

*Primary Examiner*—Robert L. Spruill
*Attorney, Agent, or Firm*—Tarolli, Sundheim & Covell

[57] ABSTRACT

A seamless tube-like blank is formed and cut into single annular parts which consecutively are profiled by means of two tools having the shape of solids of rotation. During the profiling operation, the specific surface pressure on the inside and on the outside of the workpiece is equal. Preferably, an inner profiling roller and an outer annular profiling tool is used, the mutual distance thereof being variable. Simultaneously, the inner roller acts on the workpiece with its convex outer surface, and the outer annular tool acts on the workpiece with its concave inner surface. Thus, the effective surface pressures on the inside and on the outside of the workpiece are equal during processing thereof. The apparatus is equally well suited for the manufacturing of steel rims and aluminium rims.

9 Claims, 3 Drawing Sheets

METHOD AND AN APPARATUS FOR COLD-ROLL FORMING OF ANNULAR WORKPIECES

BACKGROUND OF THE INVENTION

1. Field of the Invention

The present invention refers to a method as well as to an apparatus for cold-roll forming of annular workpieces into a desired profile, particularly for manufacturing vehicle rims consisting of aluminium.

2. Prior Art

Devices are known for the cold-roll forming an annular workpieces, particularly for the profiling of vehicle rims, which comprise two tools in the shape of solids of rotation acting on a workpiece from opposite sides, the mutual distance of the tools being variable. In order to shape e.g. a vehicle rim, it is clamped in the region of its edge between the upper and the lower tool whereby the shaping pressure is built up by decreasing the mutual distance of the two tools between which the edge of the rim is clamped. The workpiece, being in the form of a vehicle rim, rotates between the two pressed together rollers whereby the one roller acts on the outside and the other roller acts on the inside of the rim. The disadvantage of this device is the that the surface pressure on the outside is nearly three times greater than the corresponding surface pressure on the inside of the rim.

These facts can be seen from FIG. 1 showing a diagrammatic view of a known device for cold-roll forming of a vehicle rim. Reference numeral 1 designates the upper, roller-shaped tool, reference numeral 2 the lower tool having the shape of a roller too, and reference numeral 3 the workpiece. The tools 1 and 2 are pressed against the workpiece 3 with a force P. The specific pressure on the outside of the workpiece 3 is designated with $P_a$ and the specific pressure on the inside of the workpiece 3 is designated with $P_i$. The corresponding radii of the rollers and the workpiece are designated with ra, ri and rw.

In order to calculate the specific pressure on the outside and on the inside, the formula of Herz is used:

$$p = 0{,}42 \cdot \sqrt{\frac{p \cdot E}{rm \cdot L}}$$

Thereby, rm designates the means radius of the two roller bodies having the radii r1 and r2, L designates the length of the roller bodies and E designates the modulus of elasticity. Further, the following condition must be considered:

$$\frac{1}{rm} = \frac{1}{r1} + \frac{1}{r2}.$$

Using these equations, the person skilled in the art will come to the result that the following equation is true: ps $$pa = pi \cdot 2.77.$$

This means that the specific pressure on the outside of the workpiece is 2.77-times greater than the specific pressure on the inside of the workpiece.

This disadvantage is accepted in the manufacturing of steel rims because steel rims can be shaped in three consecutive steps of cold-roll forming. However, in manufacturing annular bodies consisting of light alloy, e.g. of aluminium, the conditions are different. In this case, this disadvantage can not be accepted because the soft aluminium reacts to the uneven specific surface pressures very unfavourably.

Consequently, due to these reasons, the manufacturing of vehicle rims consisting of aluminium is particularly difficult and expensive. Usually, aluminium rims are manufactured as follows: Flat aluminium sheets having the required size are bent into the shape of tubes and the free edges are connected to each other by welding. Thereafter, the processing of the tubes is effected by means of tools in the shape of solids of rotation in numerous steps.

This manufacturing process comprises a number of important disadvantages. Firstly, the grain structure of the annular body of aluminium is changed at the edges where it is welded together; there, it gets an alloy like structure with the result that the strength is considerably reduced in the region of the weld seam. Tests have shown that particularly the fatigue strength is reduced to a fraction of the original strength with the result that a rim manufactured in the way as discussed hereinabove is susceptible to break which can have severe consequences.

Furthermore, the unequal surface pressure results in further great disadvantages. The soft aluminium, compared with steel, heavily reacts on unequal surface pressures so that external influences like shocks easily can lead to a deformation of the rim.

OBJECTS OF THE INVENTION

It is an object of the invention to avoid the disadvantages discussed hereinabove and to propose a method and an apparatus for manufacturing annular workpieces shaped into a desired profile, particularly for manufacturing vehicle rims of aluminium, which have a greatly increased strength.

SUMMARY OF THE INVENTION

The present invention, therefore, provides a method for cold-roll forming of annular workpieces into a desired profile, particularly for manufacturing vehicle rims consisting of aluminium. According to the invention, a seamless shaped tube-like blank is provided and cut into single annular parts having a width essentially corresponding to the width of the annular workpieces to be processed. Then, said annular part to be processed is supported on its circumference and freely hanging down and driven to a rotational movement. Finally, the cold-roll forming operation of said annular part is performed at the supporting place with equal specific pressure on the inner surface as well as on the outer surface.

The tube-like blank can be manufactured either by pouring molten aluminium in a corresponding metallic mould or by injection of the molten aluminium into the mould under high pressure.

In order to achieve the desired equal specific pressures on the inside and on the outside of the annular body, the cold-roll forming is performed by means of the convex outer surface of a first inner tool having the shape of a solid of rotation as well as with the concave inner surface of a second outer tool having the shape of a solid of rotation, both said first and second tools acting simultaneously at said supporting place on the workpiece.

An apparatus for performing the method of the invention comprises an outer tool having in inner profiling surface, said outer tool being a rotatable annular body consisting of one piece and loosely surrounding the workpiece to be shaped. Further, it comprises an inner tool having an outer profiling surface and located in the interior of said outer tool, said inner tool being a roller member with a diameter less than the workpiece to be shaped.

In the following, it will be shown that the required condition, i.e. that the specific pressure is essentially the same at the outside and at the inside of the workpiece, can be met if the above mentioned characteristics are observed. This means, however, that steel rims as well as light alloy rims can be manufactured using the same method and the same apparatus. Thus, an important simplification and improvement in the manufacturing of vehicle rims is attained.

BRIEF DESCRIPTION OF THE DRAWINGS

In the following, the invention will be described in more detail, with reference to the accompanying drawings.

DESCRIPTION OF A PREFERRED EMBODIMENT

In order to provide a seamless tube-like blank, an aluminium tube is manufactured by means of an extruding press. Such a manufacturing process allows to achieve a high degree of deformation in a single step of shaping under pressure from all sides. The tube is manufactured starting with initially cast cylindrical billets which are heated to processing temperature, inserted into the ingot receiving means of an extruding press and pressed through a die of the extruding press by means of a plunger means. Thereby, a tube-like blanket results which does not have a seam and which is cut in individual annular parts. The annular parts have a width essentially corresponding to the width of the annular workpieces which are to be shaped into rims. During the shaping step, the profiling is effected at the outside with the same specific pressure as on the inside.

Figure 2:
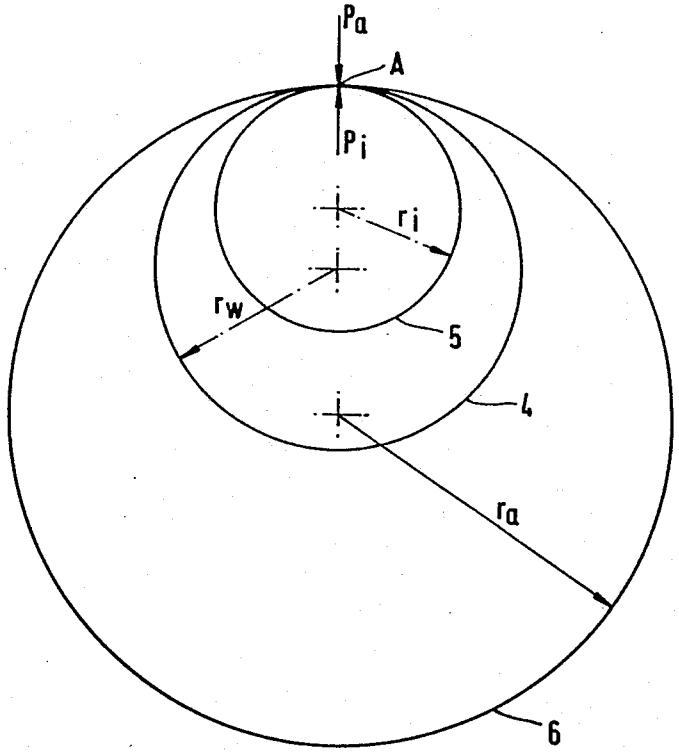
FIG. 2 is a diagrammatic representation of the apparatus of the invention.
Figure 1:
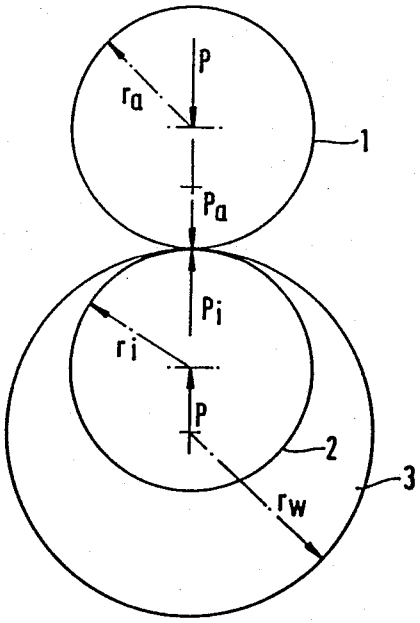
FIG. 1 is a diagrammatic representation of a known apparatus.

The further processing is performed in an apparatus diagrammatically shown in FIG. 2. The workpiece 4 has the shape of an annular body and is profiled by means of two cooperating tools having the shape of solids of rotation. For this purpose, an inner roller 5 is provided by means of which the inside of the workpiece 4 is processed along the mutual contact line A. The outer surface of the workpiece 4 is profiled by means of an outer roller 6 which contacts the workpiece 4 along the same line A, but on the outside of the workpiece. The inner roller 5 contacts the workpiece 4 with its convex outer surface, while the outer roller 6 contacts the workpiece with its inner concave surface. The outer surface of the inner roller 5 is described as being convex in the sense that it is the outer surface of a generally circular body as shown schematically in FIG. 2. The outer surface of the inner roller 5 may however have a varying profiled shape, as exemplified in the outer profiling surface 13 (FIG. 3) of the inner tool 12. Similarly, the inner surface of the outer roller 6 is described as being concave in the sense that it is the inner surface of a generally annular body as shown schematically in FIG. 2. The inner surface of the outer roller 6 may however have a varying profiled shape, as exemplified in the inner profiling surface 11 (FIG. 3) of the outer tool 10. The surface pressure on the outside is designated by $P_a$ and the surface pressure on the inside is designated by $P_i$. The inner roller 5 has a radius ri, the workpiece a radius rw and the outer roller 6, which preferably has annular shape, a radius ra.

The calculation of the specific inner pressure and the specific outer pressure is done again with the help of the formula of Herz and yields a result: pi=pa.

The relation between the radius rw of the workpiece 4 and the radius ri of the inner roller 5 may be in the region of 1.5.

Figure 3:
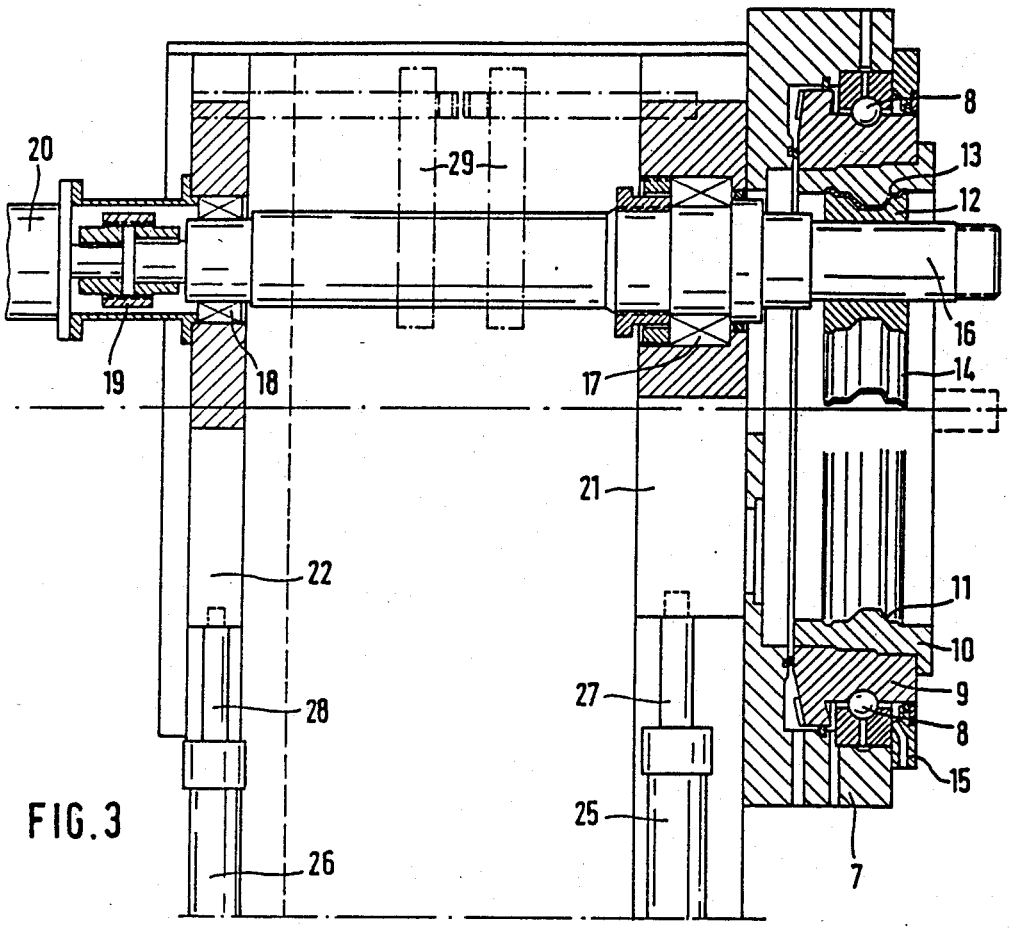
FIG. 3 is a vertical sectional view of a preferred embodiment of the apparatus of the invention.
Figure 4:
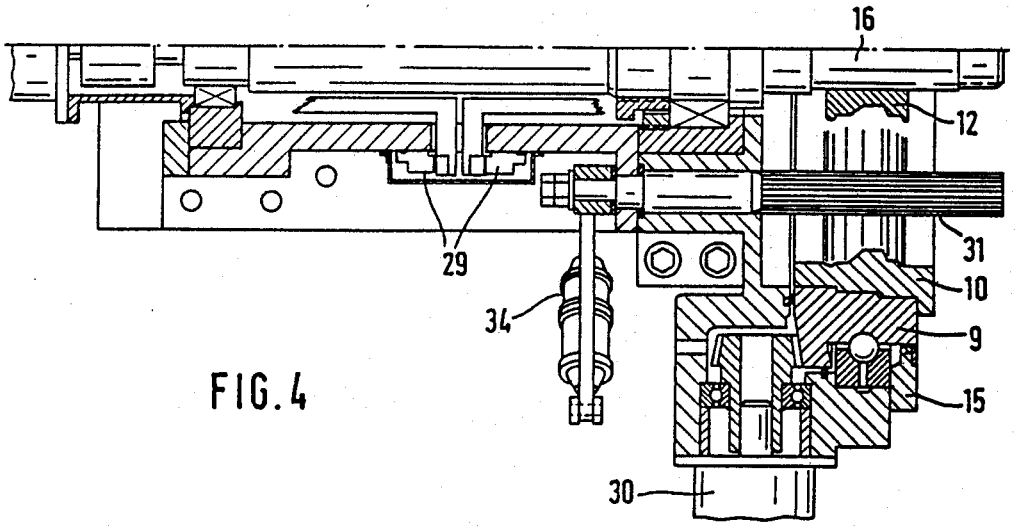
FIG. 4 is a horizontal sectional view of a preferred embodiment of the apparatus of the invention.
Figure 5:
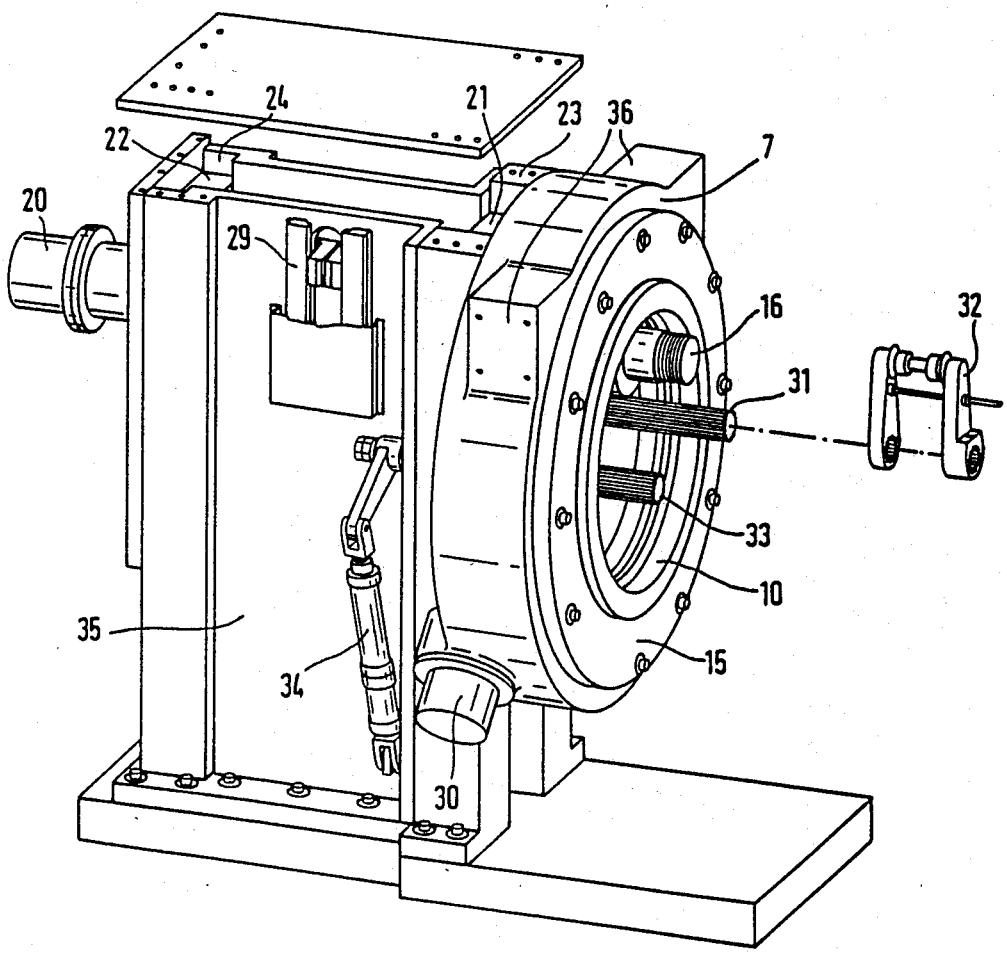
FIG. 5 is a general view of the apparatus of the invention.

Referring now to FIGS. 3, 4 and 5, an example of the apparatus according to the invention will be described in more detail.

The apparatus comprises a housing 7 in which an outer annular member 9 is rotatably received and supported by means of ball bearings 8; the annular member 9 serves to receive the outer tool 10. The outer tool 10 is of annular shape as well and includes an inner profiling surface 11. An inner tool 12 cooperating with the outer tool 10 has also the shape of a solid of rotation and comprises an outer profiling surface 13. The profiling surfaces 11 and 13 correspond to each other, i.e. The surface 13 has the negative shape of the surface 11. the diameter of the inner tool 12 is considerably smaller than the diameter of the outer tool 10, whereby the arrangement is such that the outer surface of the inner tool 12 touches the inner surface of the outer tool 10. At the place where the two tools 10 and 12 contact each other, the profiling of the workpiece 14 is performed in such a way that the inner tool 12 is pressed against the outer tool 10 with the workpiece to be profiled therebetween. The housing 7 is closed at its front side by a annular bearing cover 15.

The inner tool which is not shown in FIG. 5 is mounted on a shaft 16 which extends through the housing 7 and is supported outside the housing by means of two bearings 17 and 18 which are displaceable in their height position. The other end of the shaft 16, remote from the inner tool 12, is connected to a hydraulic motor 20 by means of a resilient coupling member 19.

In order to enable the shaft 16 to be vertically displaced, the bearings 17 and 18 are received in guide members 21 and 22 which are supported by means of bearing guide members 23 and 24. The glide members 21 and 22 are operatively coupled to hydraulic presses 25 and 26, the piston rods thereof being connected to the glide members 21 and 22. The hydraulic press 25 is of considerably greater dimension than the hydraulic press 26 because, due to the lever conditions constructionally present in the apparatus, the press 25 has to yield a much higher force than the press 26. The movement of the two presses 25 and 26 is coupled and is monitored by means of glass rules 29.

A further hydraulic motor 30 is designated with 30 which serves to drive the outer tool 10 to a rotational movement. Finally, it should be mentioned that a further shaft 31 is provided serving to receive a lateral guiding member 32 which centers the workpiece 14 in a way which is not explicitly described. The lateral guiding member 32 is pivotally mounted and may be driven by a pneumatic cylinder 34 with integrated power transmission which is connected to the side wall 35 of the apparatus.

The feeding of the workpiece to the apparatus and the removing of the same therefrom is effected by means of a (not shown) loading-unloading means which is received on an axially displaceable shaft 33. The workpieces to be processed by the apparatus of the invention are automatically fed whereby the transport means adapted to perform this feeding operation is connected to the flanges 36 of the housing 7. Thus, the workpiece 14 to be processed is hung on the inner tool 12 which has a considerably smaller diameter than the smallest workpiece to be processed with the apparatus. A centering is effected by means of the lateral guiding member 32. During all these operations, the shaft 16 is in its lowermost position in which the piston rods 27 and 28 are retracted.

In order to effect the profiling of the workpiece, the hydraulic presses 25 and 26 are activated with the consequence that the piston rods 27 and 28 are extended and displace the shaft 16 upwards, whereby care is taken that the shaft 16 always is maintained in an exactly horizontal position. This can be checked by means of the glass rules 29. The actual profiling of the workpiece 14 is performed by the cooperation of the inner tool 12 with the outer tool 10 such that both tools are driven to a rotational movement and simultaneously pressed against each other, with the workpiece received therebetween. As soon as the workpiece has been finished, i.e. if it has the desired profile shape, the piston rods 27 and 28 are retracted and the shaft 16 is displaced vertically downwards. The finished workpiece 14 hangs on the inner tool 12 and is released from the outer tool 10. Finally, the workpiece is removed from the inner tool 12 by means of the loading-unloading means and passed over to transporting means (not shown) for further processing.

With the apparatus hereinbefore described, annular workpieces, particularly vehicle rims consisting of steel as well as of aluminium, can be effectively and quickly shaped. As already mentioned, the specific surface pressures exerted during the profiling process are equal on the inside as well as on the outside with the result that workpieces of aluminium can be processed without any problems usually encountered in the coldroll forming of aluminium. Thus, the manufacturing of vehicle rims is simplified, rendered less expensive and accelerated, the so produced aluminium rims having even a much better quality than the ones manufactured according to any previously known method.

What I claim is:

1. A method for cold-roll forming of annular workpieces into a desired profile, particularly for manufacturing vehicle rims consisting of aluminium, comprising the steps of:

providing a seamless shaped tube-like blank;

cutting said tube-like blank into single annular parts having a width essentially corresponding to the width of the annular workpieces to be processed;

supporting said annular part to be processed on its circumference and freely hanging down;

driving said annular part to a rotational movement; and cold-roll forming said annular part at the supporting place with equal specific pressure on the inner surface as well as on the outer surface.

2. A method according to claim 1, in which the cold-roll forming is performed by means of the convex outer surface of a first inner tool having the shape of a solid of rotation as well as with the concave inner surface of a second outer tool having the shape of a solid of rotation, both said first and second tools acting simultaneously at said supporting place on the workpiece.

3. An apparatus for cold-roll forming of an annular workpiece into a desired profile, especially for manufacturing a vehicle wheel rim of aluminum, said workpiece having an inner surface and an outer surface, said apparatus comprising:

means for supporting the annular workpiece at a supporting location on its circumference and freely hanging down;

means for rotating the annular workpiece; and means for cold-roll forming the annular workpiece at said supporting location with equal specific pressure on the inner and outer surfaces of the workpiece, comprising an outer profiling tool having an inner profiling surface, said outer tool being a rotatable annular body engageable with the outer surface of the workpiece, and an inner tool having an outer profiling surface and disposed radially within said outer tool, said inner tool being a roller member with a diameter less than the diameter of the workpiece and engageable with the inner surface of the annular workpiece, said first and second tools acting simultaneously at said supporting location on the workpiece;

wherein the relation of the radii of the inner tool and the outer tool is determined in accordance with the formula $$p = 0.42 \cdot \sqrt{\frac{p \cdot E}{r_m \cdot L}}$$

with the condition of an identical surface pressure on the inner and outer surfaces of the workpiece, wherein p is the surface pressure, P is the force with which the inner tool and the outer tool are pressed against the workpiece, $r_m$ is the mean radius of the inner and outer tools, E is the modulus of elasticity of the workpiece, and L is the length of the body of the tool.

4. An apparatus according to claim 3, in which said inner tool is mounted on the one end of a shaft, the other end of said shaft being driven to a rotational movement, said shaft being received in two vertically movable bearings.

5. An apparatus according to claim 4, in which said outer tool is driven by means of a hydraulic motor.

6. An apparatus according to claim 5, in which said bearings are vertically displaceably guided in gliding members to adjust the height of said shaft and are operatively connected to hydraulic presses.

7. An apparatus according to claim 6, in which said presses are of different dimensions and operatively connected to each other.

8. An apparatus according to claim 7, in which glass rules are provided to monitor the movement of said two operatively coupled presses and the horizontal position of said shaft.

9. A method of cold-roll forming an annular workpiece into a desired profile, especially for manufacturing a vehicle wheel rim of aluminum, comprising the steps of:

providing an annular workpiece having an inner surface and an outer surface;

supporting said annular workpiece at a supporting location on its circumference;

rotating said annular workpiece; and cold-roll forming said annular workpiece at said supporting location with equal specific pressure on the inner surface and on the outer surface by means of a convex outer forming surface of a first inner tool comprising a roll and a concave inner forming surface of a second outer tool comprising a roll, said first and second tools acting simultaneously at the supporting location on the workpiece;

wherein the relation of the radii of the inner tool and the outer tool is determined in accordance with the formula $$p = 0.42 \cdot \sqrt{\frac{p \cdot E}{r_m \cdot L}}$$

with the condition of an identical surface pressure on the inner and outer surfaces of the workpiece, wherein p is the surface pressure, P is the force with which the inner tool and the outer tool are pressed against the workpiece, $r_m$ is the mean radius of the inner and outer tools, E is the modulus of elasticity of the workpiece, and L is the length of the body of the tool.

* * * * *